US010844683B2

(12) United States Patent
Wilson

(10) Patent No.: US 10,844,683 B2
(45) Date of Patent: Nov. 24, 2020

(54) HYDRAULIC DRILLING JAR WITH HYDRAULIC LOCK PISTON

(71) Applicant: Weatherford Technology Holdings, LLC, Houston, TX (US)

(72) Inventor: Timothy Wilson, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 375 days.

(21) Appl. No.: 15/944,147

(22) Filed: Apr. 3, 2018

(65) Prior Publication Data

US 2019/0301257 A1 Oct. 3, 2019

(51) Int. Cl.
*E21B 31/113* (2006.01)
*E21B 34/12* (2006.01)
*E21B 31/107* (2006.01)

(52) U.S. Cl.
CPC ..... *E21B 31/1135* (2013.01); *E21B 31/107* (2013.01); *E21B 31/113* (2013.01); *E21B 34/12* (2013.01); *E21B 34/125* (2013.01)

(58) Field of Classification Search
CPC .. E21B 31/107; E21B 31/113; E21B 31/1135; E21B 34/12; E21B 34/125
See application file for complete search history.

(56) References Cited

U.S. PATENT DOCUMENTS 4,081,043 A 3/1978 Jeurgens
5,033,557 A 7/1991 Askew
5,052,485 A 10/1991 Reid
5,086,853 A * 2/1992 Evans ..... E21B 31/113 175/297
5,123,493 A * 6/1992 Wenzel ..... E21B 31/113 166/178
5,318,139 A 6/1994 Evans
5,624,001 A 4/1997 Evans
5,984,028 A 11/1999 Wilson
6,135,217 A 10/2000 Wilson
(Continued)

FOREIGN PATENT DOCUMENTS

WO 02095180 A2 11/2002

OTHER PUBLICATIONS

Extended European Search Report in corresponding application EP 19166879.7 dated Sep. 3, 2019.

*Primary Examiner* — Tara Schimpf
(74) *Attorney, Agent, or Firm* — Vorys, Sater, Seymour and Pease LLP

(57) ABSTRACT

A jarring device includes a housing, a mandrel received within the housing, and a pressure chamber defined between the housing and the mandrel and filled with a hydraulic fluid. A hydraulic lock piston is arranged about the mandrel and radially interposes the housing and the mandrel. The hydraulic lock piston includes a pressure piston having a first end exposed to the pressure chamber, a second end, and first and second fluid flowpaths defined in the pressure piston and extending axially between the first and second ends. When the mandrel moves in a first direction relative to the housing, the hydraulic fluid is metered through the first fluid flowpath and the second fluid flowpath is occluded. When the mandrel moves in a second direction relative to the housing and opposite the first direction, the hydraulic fluid is metered through the second fluid flowpath and the first fluid flowpath is occluded.

20 Claims, 12 Drawing Sheets

(56) References Cited

U.S. PATENT DOCUMENTS

| | | | |
|---|---|---|---|
| 6,202,767 | B1 | 3/2001 | Friis |
| 7,299,872 | B2 | 11/2007 | Darnell |
| 7,347,287 | B2 | 3/2008 | Chancey |
| 7,814,995 | B2 | 10/2010 | Clausen et al. |
| 8,011,427 | B2 | 9/2011 | Shoyhetman et al. |
| 8,151,910 | B2 | 4/2012 | Swinford |
| 8,505,653 | B2 | 8/2013 | Shoyhetman et al. |
| 8,695,696 | B2 | 4/2014 | Shoyhetman et al. |
| 8,783,353 | B2 | 7/2014 | Saheta et al. |

* cited by examiner

HYDRAULIC DRILLING JAR WITH HYDRAULIC LOCK PISTON

BACKGROUND

Downhole drilling operations generally require a drill string suspended from a drilling rig at a surface location. The drill string includes several tubular sections coupled end to end and extended into a borehole. A drill bit is attached to the bottom end of the drill string and is rotated to penetrate (drill through) subterranean formations.

During drilling and completion operations, a need may arise generate a jarring force on the drill string for a variety of reasons. For example, jarring forces may be utilized to retrieve a downhole tool lodged within the borehole, to set or pull tools or plugs, to retrieve or a downhole retrievable (alternately referred to as a "fishing operation"), to manipulate a downhole tool, or to dislodge (free) a stuck drill string. Downhole jarring devices are commonly used to provide the desired jarring forces, and are operable to produce upward and/or downward impact forces.

Hydraulic drilling jars are one type of jarring device and commonly operate based on tensile or compression loads assumed through the drill string. Hydraulic drilling jars typically include an outer pipe body (or housing), an inner pipe body (or mandrel), and an annular pressure chamber defined therebetween and filled with a hydraulic fluid. The outer and inner pipe bodies are coaxially displaceable relative to each other based on drilling rig loading on the drill string and a metering hydraulic fluid out of the pressure chamber at a predetermined flow rate. When the hydraulic drilling jar actuates and hydraulic pressure suddenly releases in the pressure chamber, the outer and inner pipe bodies rapidly accelerate relative to one another and simultaneously drive a hammer to strike an opposing anvil with great force. The impact of the hammer against the anvil produces a jarring effect that is transmitted through the drill string.

For maximum flexibility, hydraulic jars can be bidirectional and otherwise designed to generate impact blows in both the "up" and "down" directions within the borehole. Since it is desirable to have separate release timings for up and down jarring motions, conventional jarring devices commonly incorporate two separate pressure chambers capable of providing different hydraulic fluid metering timings based on up or down movement. The dual pressure chambers, however, add length and cost to the jarring device.

Moreover, some hydraulic drilling jars incorporate a mechanical lock designed with threshold push and pull values that must be overcome through the drill string before the drilling jar can operate. Mechanical locks, however, can slow down internal hydraulic fluid transfer and thus slow ultimate velocity and impact of the drilling jar. Furthermore, mechanical locks increase the complexity and cost of the jarring device.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to jarring devices used in the oil and gas industry and, more particularly, to hydraulic drilling jars that incorporate a hydraulic lock piston that allows different unlocking loads for up and down jarring, and further allows different metering times for up and down jarring.

Embodiments disclosed herein describe a jarring device that includes a housing, a mandrel received within the housing and movable relative thereto, and a pressure chamber defined between the housing and the mandrel and filled with a hydraulic fluid. A hydraulic lock piston is arranged about the mandrel and radially interposes the housing and the mandrel, the hydraulic lock piston may include a pressure piston that has a first end exposed to the pressure chamber, a second end, and first and second fluid flowpaths that extend axially between the first and second ends. When the mandrel moves in a first direction relative to the housing, the hydraulic fluid is metered through the first fluid flowpath and the second fluid flowpath is occluded. In contrast, when the mandrel moves in a second direction relative to the housing and opposite the first direction, the hydraulic fluid is metered through the second fluid flowpath and the first fluid flowpath is occluded. The hydraulic lock piston may be designed to create a threshold locking effect hydraulically instead of mechanically, and thus has no effect on fluid flow after jar release. Moreover, the hydraulic lock piston may be designed to facilitate an unlocking load threshold that is different for up and down jarring motions, and may further provide different metering times for up and down jarring, which can be a desirable function with or without the locking feature.

Figure 1:
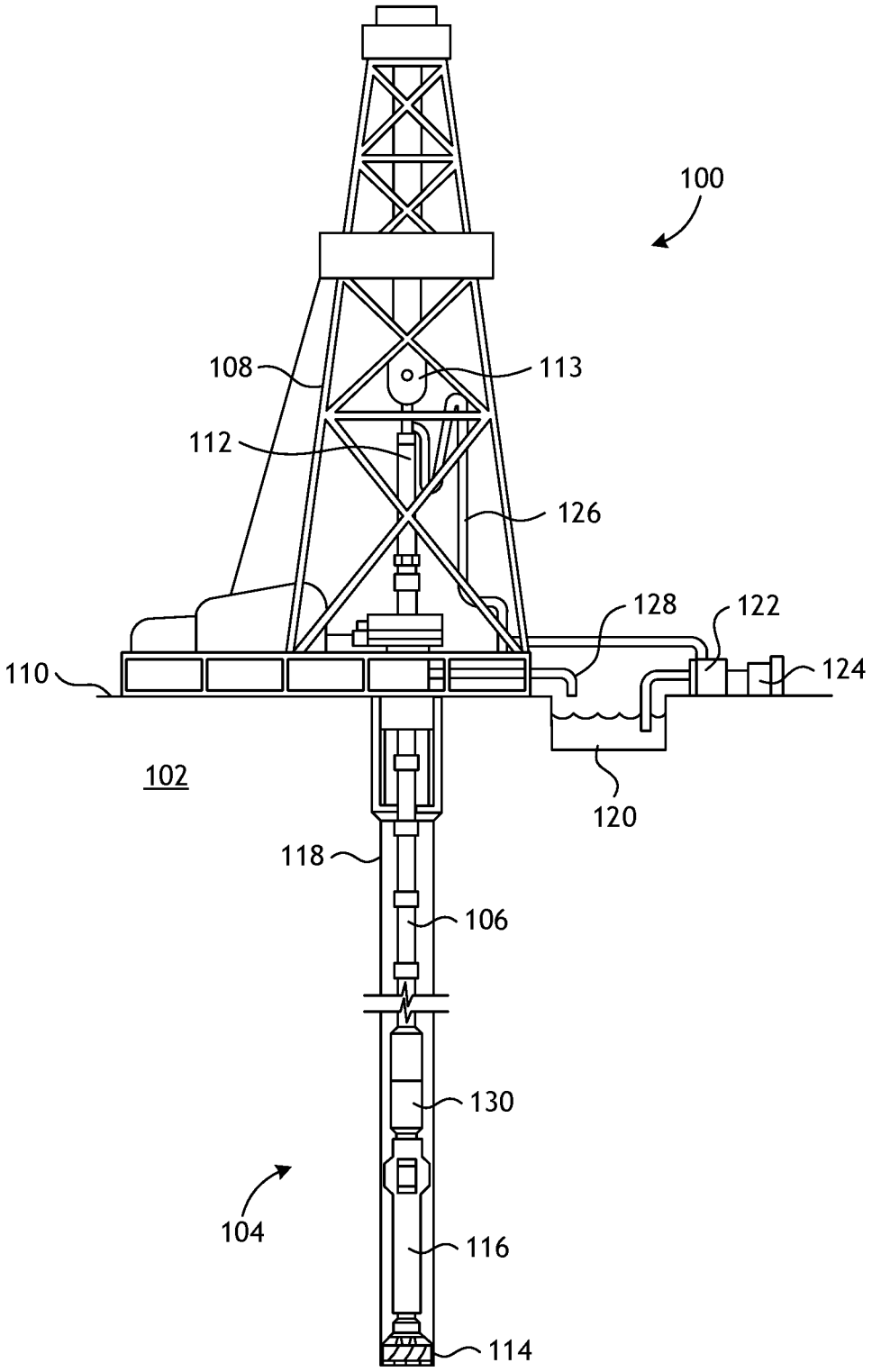
FIG. 1 is an example drilling system that may employ the principles of the present disclosure.

Referring to FIG. 1, illustrated is an example drilling system 100 that may employ one or more principles of the present disclosure. Boreholes may be created by drilling into the earth 102 using the drilling system 100. The drilling system 100 may be configured to drive a bottom hole assembly (BHA) 104 arranged at the bottom of a drill string 106 extended into the earth 102 from a drilling rig 108 (e.g., a derrick) arranged at the surface 110. In some embodiments, the BHA 104 may form an integral extension or portion of the drill string 106. The drilling rig 108 includes a kelly 112 and a traveling block 113 used to lower and raise the kelly 112 and the drill string 106. In some embodiments, however, the kelly 112 may be replaced with a top drive or the like.

The BHA 104 may include a drill bit 114 operatively coupled to a tool string 116 which is moved within a drilled wellbore 118 as attached to the drill string 106. During operation, the drill bit 114 penetrates the earth 102 and thereby creates the wellbore 118. The BHA 104 may provide directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to monitor and report downhole measurements of drilling conditions.

Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles provided on the drill bit 114 and thereby cools the drill bit 114. After exiting the drill bit 114, the mud circulates back to the surface 110 via the annulus defined between the wellbore 118 and the drill string 106, and in the process returns drill cuttings and debris to the surface 110. The cuttings and mud mixture are passed through a flow line 128 and are processed such that a cleaned mud is returned downhole through the stand pipe 126 once again.

According to embodiments of the present disclosure, a jarring device 130 may also be included in the drilling system 100. In some embodiments, as illustrated, the jarring device 130 may form part of the BHA 104, but may alternatively be positioned at other locations along the drill string 106, without departing from the scope of the disclosure. The jarring device 130 may comprise a hydraulic drilling jar used to selectively generate impact loads transmittable through the drill string 106 for a variety of purposes, such as dislodging the drill string 106 from a stuck position.

Although the jarring device 130 is shown in conjunction with the drilling system 100 and a hydrocarbon drilling operation, it will be appreciated that the jarring device 130 may be used in a variety of other contexts, without departing from the scope of the disclosure. For example, disclosed systems and methods can be used in other types of drilling applications, such as mineral exploration, environmental investigation, natural gas extraction, mining operations, water wells, geothermal wells, and the like. Moreover, disclosed systems and methods can be used in non-drilling applications, such as wellbore fishing or cleaning operations, running and setting a downhole tool (e.g., a wellbore packer), running liner hangers, running completion strings, and facilitating wellbore completion operations. Accordingly, the jarring device 130 may be extended into the borehole 118 on other types of conveyances, such as coiled tubing, casing, or other interconnected tubulars extendable from a suitable surface rig. Consequently, the drill string 106 may alternatively be referred to herein as a "conveyance" not necessarily tied to a drilling application, but potentially tied to a completion operation, a tool extraction operation, or any other downhole intervention application.

Figure 2:
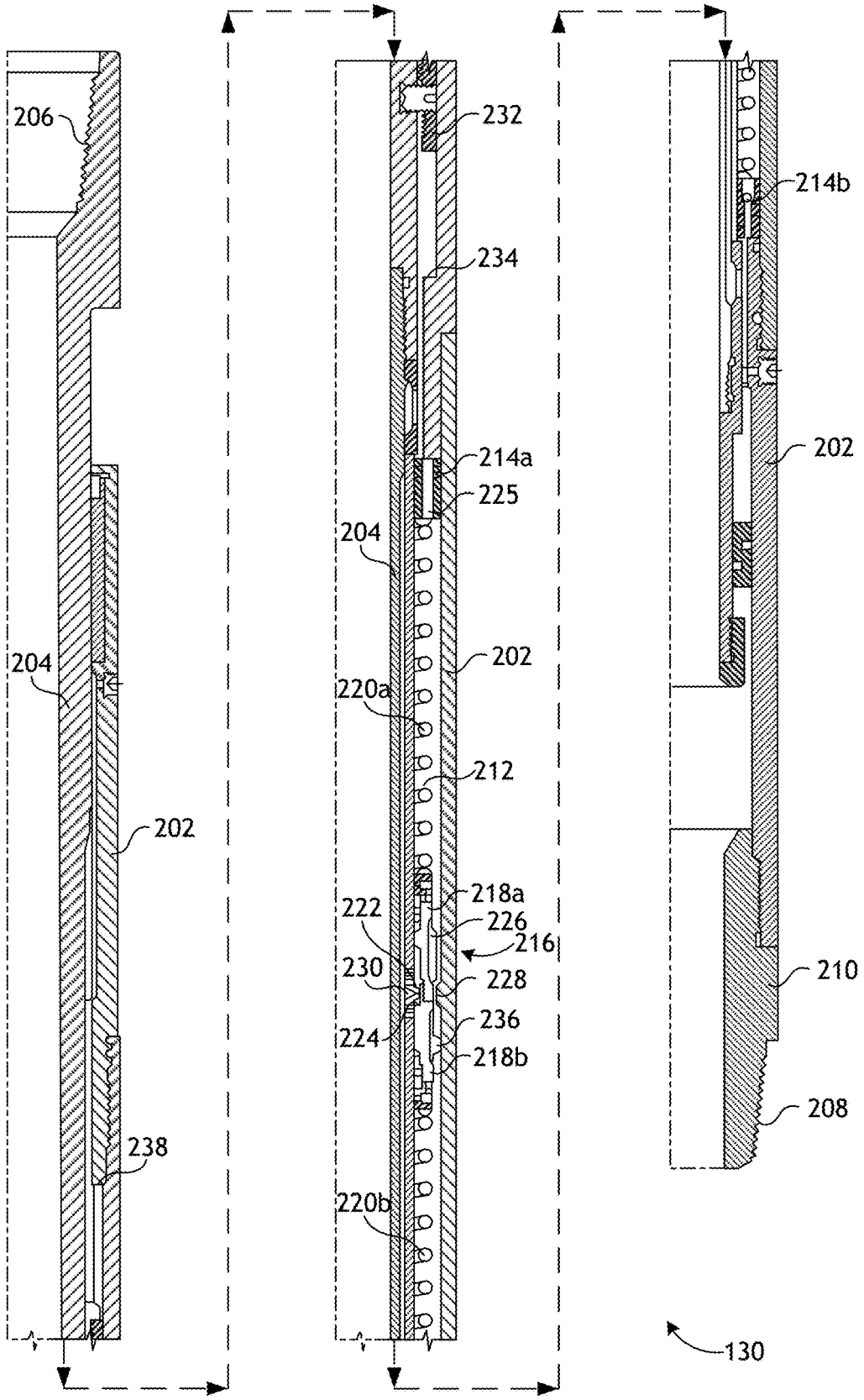
FIG. 2 (Prior Art)
FIG. 2 is an enlarged cross-sectional view of the jarring device of FIG. 1.

FIG. 2 is a progressive, enlarged cross-sectional view of a prior art example of the jarring device 130, according to one or more embodiments. As illustrated, the jarring device 130 includes a housing 202 (alternately referred to as an "outer pipe body") and a mandrel 204 (alternately referred to as an "inner pipe body") concentrically received within the housing 202. The mandrel 204 is connectable to the drill string 106 (FIG. 1) at an upper threaded opening 206 and connectable to the BHA 104 (FIG. 1) at a lower threaded connection 208, which may be provided on a lower sub 210 or the like.

A pressure chamber 212 is defined between the housing 202 and the mandrel 204 and is filled with a hydraulic fluid. An upper pressure piston 214*a* and a lower pressure piston 214*b* are positioned within the pressure chamber 212 and help regulate circulation of the hydraulic fluid within the pressure chamber 212 during operation of the jarring device 130.

A tripping valve 216 is also positioned within the pressure chamber 212 and includes an upper valve member 218*a* and a lower valve member 218*b* that are separable upon actuating the jarring device 130. In some embodiments, as illustrated, the upper and lower valve members 218*a,b* may provide an overlapping interface, but could alternatively engage each other in an abutted engagement, without departing from the scope of the disclosure. Upper and lower coil springs 220*a* and 220*b* are arranged within the pressure chamber 212 on opposing sides of the tripping valve 216 and operate to generally maintain the position of the tripping valve 216 at a central location within the pressure chamber 212.

A drill string (e.g., drill string 106 of FIG. 1) is typically several thousand feet in length as suspended from a drilling rig (e.g., the drilling rig 108 of FIG. 1). Gravity acts on and causes a downward force to be placed on the drill string, which is countered by an opposing upward force exerted on the bottom of the drill string where the drill bit engages underlying subterranean formations. These opposing forces equalize at a neutral point in the drill string, above which the drill string is stretched in tension, and below which the drill string (e.g., the BHA 104 of FIG. 1) is in compression. It is desirable to position the jarring device 130 in the drill string where it can reside at or near the neutral point during drilling operations.

To provide a downward jarring load with the jarring device 130, tension is released from the upper portions of the drill string 106 (FIG. 1), which moves the neutral point further uphole within the drill string 106. Moving the neutral point uphole results in a compressive downward force being applied against the mandrel 204 that urges the mandrel 204 to move downward relative to the housing 202. As the mandrel 204 moves downward, a flange 222 provided by the mandrel 204 engages an actuating surface 224 provided on the lower valve member 218*b*. Further movement of the mandrel 204 in the downward direction urges the tripping valve 216 to correspondingly move in the same direction. At this point, the upper and lower valve members 218*a,b* have not separated, owing to the opposing forces of the coil springs 220*a,b* combined with the rising internal pressure of the pressure chamber 212.

Downward movement of the mandrel 204 carries with it the upper pressure piston 214*a*, which reduces the volume of the pressure chamber 212 and, consequently, is resisted by the hydraulic fluid present within the pressure chamber 212. The lower pressure piston 214*b* may comprise a check valve that prevents the outflow of hydraulic fluid therethrough. In contrast, the upper pressure piston 214*a*, may define an orifice 225 (alternately referred to as a "weep hole") that allows a metered amount of hydraulic fluid to flow therethrough, which results in the mandrel 204 slowly moving downward at a predetermined rate.

The internal pressure of the pressure chamber 212 acts against the outer surfaces of the valve members 218*a,b* and urges them together to maintain their closed position. The tripping valve 216 is carried downward until an upper valve flange 226 on the upper valve member 218*a* engages a housing flange 228 defined on the inner radial surface of the housing 202. At this point, the upper valve member 218*a* is restrained against further downward movement by the interaction (engagement) of the upper valve flange 226 and the housing flange 228.

Continual downward movement of the mandrel 204 forces the valve members 218*a,b* to axially separate and thereby open the tripping valve 216. More specifically, as the mandrel 204 moves downward, the flange 222 is forced against the actuating surface 224 of the lower valve member 218*b*, causing it to separate from the upper valve member 218*a* and thereby open the tripping valve 216. Opening the tripping valve 216 exposes internal passages 230, into which the hydraulic fluid quickly flows and thereby drastically reduces the fluid pressure from within the pressure chamber 212. With a substantial pressure reduction in the pressure chamber 212, downward movement of the mandrel 204 relative to the housing 202 is no longer resisted by fluid pressure. Consequently, the mandrel 204 may move rapidly downward into the housing 202, thereby causing a hammer 232 carried by the mandrel 204 to sharply strike an opposing surface of an anvil 234 provided by the housing 202.

In contrast, an upward jarring load (function) begins by withdrawing or pulling upwards on the mandrel 204 relative to the housing 202, which moves the neutral point further downhole within the drill string 106 (FIG. 1) and thereby places a tensile upward force on the mandrel 204 that urges the mandrel 204 to move upward relative to the housing 202. The upward jarring motion is similar to the downward jarring motion except a lower valve flange 236 is used against the housing flange 228 in the upward direction. Upon opening the tripping valve 216, upward movement of the mandrel 204 relative to the housing 202 is no longer resisted by fluid pressure, which allows the hammer 232 to accelerate upward and sharply strike a second or "upper" anvil 238 provided by the housing 202. In other embodiments, however, the principles of the present disclosure can be used with the jarring device 130 being designed such that the anvil 234 (i.e., the "first" anvil) alternatively accelerates to sharply strike the hammer 232 and thereby provide the upward jarring force. For the sake of brevity, further description of the operation of the tripping valve 216 can be found in U.S. Pat. Nos. 6,135,217 and 5,086,853, the contents of each of which are hereby incorporated by reference.

It is sometimes advantageous for hydraulic drilling jars, such as the jarring device 130, to have predetermined threshold push and pull values that must be reached or otherwise overcome before the jarring device starts to meter hydraulic fluid for a full jar release. This helps prevent the occurrence of premature or inadvertent jarring release while simply moving the drill string within the borehole. In conventional hydraulic drilling jars, a mechanical lock is commonly included as a subsystem of the drilling jar to address this issue. Mechanical locks, however, typically slow down internal hydraulic fluid transfer as the fluid is commonly transferred around the mechanical lock and thus slows ultimate velocity and impact. Moreover, mechanical locks can increase the complexity and cost of the jarring device.

Another desirable feature for hydraulic drilling jars is to have separate release timings for up and down jarring motions. Since down jarring is usually performed at a lower slack off weight on the drill string than the over-pull force required for up jarring, it can be advantageous to meter the hydraulic fluid faster during the down jarring cycle as compared to the up jarring cycle. This issue is addressed in conventional jarring devices by incorporating two pressure chambers, which adds length and cost to the jarring device.

The present disclosure includes embodiments of an example hydraulic lock piston that can address the above-described issues without incorporating a mechanical lock or plural pressure chambers. The hydraulic lock piston described herein may replace the upper pressure piston 214*a* generally described above, thus not requiring any substantial changes to assembly, filling, or operation of the jarring device 130 (or other types of hydraulic drilling jars). Moreover, the hydraulic lock piston may be designed to create a threshold locking effect hydraulically instead of mechanically, and thus has no effect on fluid flow after jar release. Consequently, the hydraulic lock piston also avoids issues relating to mechanical lock wear, which can cause contamination of the hydraulic fluid and alter the performance of the mechanical lock as the internal parts wear over time. The hydraulic lock piston may also be designed to facilitate an unlocking load threshold that is different for up and down jarring motions, and may further provide different metering times for up and down jarring, which can be a desirable function with or without the locking feature.

Figure 3:
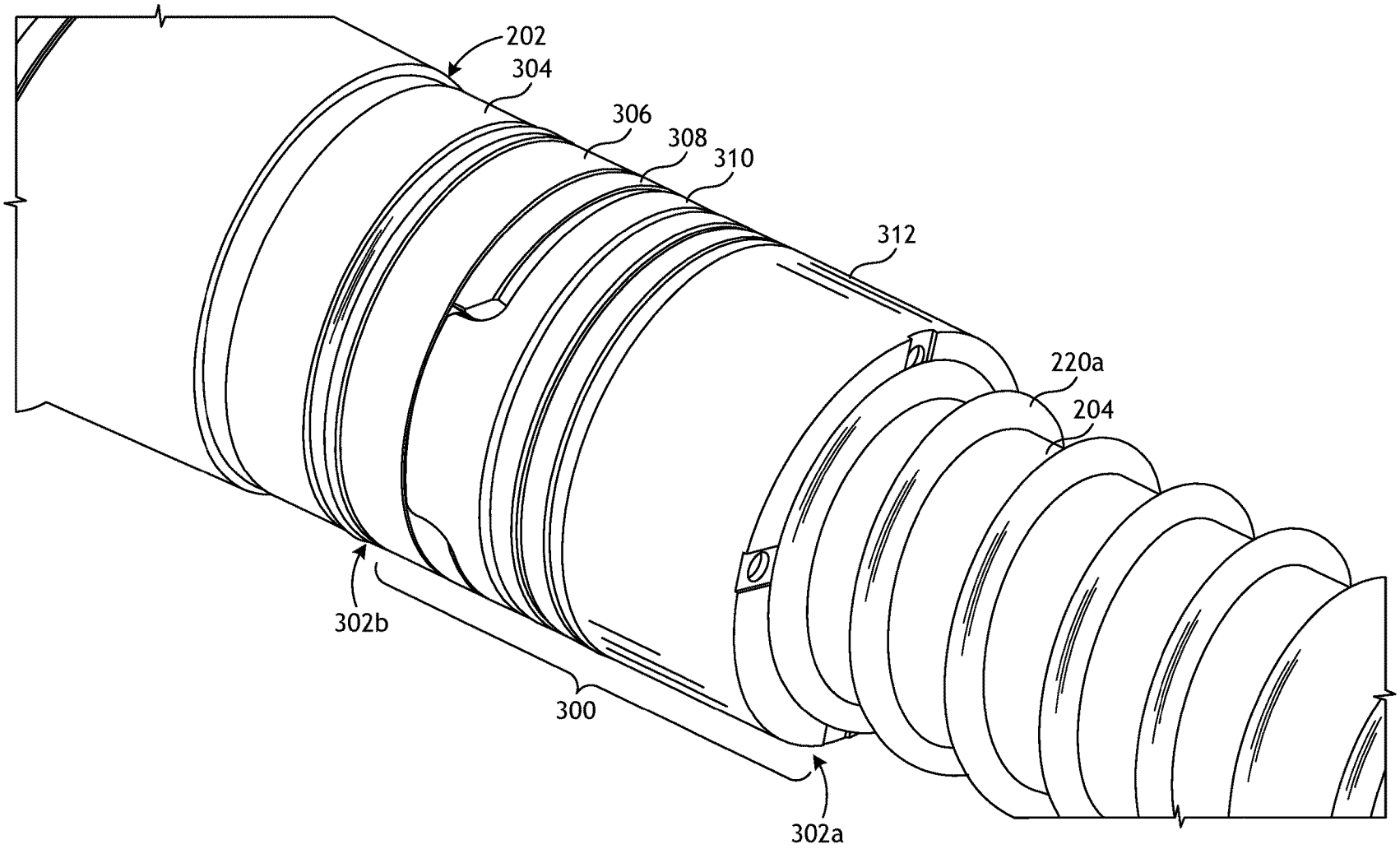
FIG. 3 is an isometric view of an example hydraulic lock piston.

FIG. 3 is an isometric view of an example hydraulic lock piston 300, according to one or more embodiments of the present disclosure. As indicated above, the hydraulic lock piston 300 may replace the upper pressure piston 214*a* of FIG. 2 and thus may be used in conjunction with the jarring device 130 of FIG. 2. Accordingly, the hydraulic lock piston 300 may be best understood with reference to FIG. 2, where like numerals will refer to similar components not described again in detail.

As illustrated, the hydraulic lock piston 300 may be assembled onto the mandrel 204 and may include several component parts arranged coaxially in succession (series). The hydraulic lock piston 300 may have a first or "downhole" end 302*a* and a second or "uphole" end 302*b*. The upper coil spring 220*a* may engage the downhole end 302*a*, and the uphole end 302*b* may be arranged adjacent an inner collar portion 304 of the housing 202. The hydraulic lock piston 300 may include a bearing ring 306, a valve plate 308, a cap 310, and a pressure piston 312, each of which will be described in more detail below.

Figure 4B:
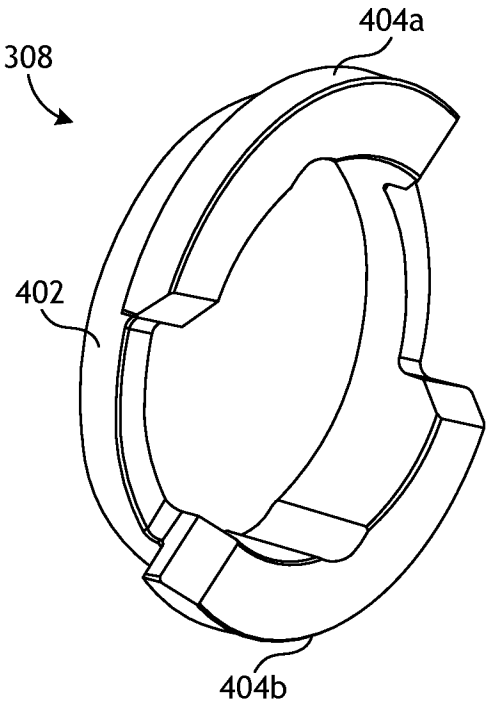
FIG. 4B is an isometric view of the valve plate of FIG. 3.
Figure 4A:
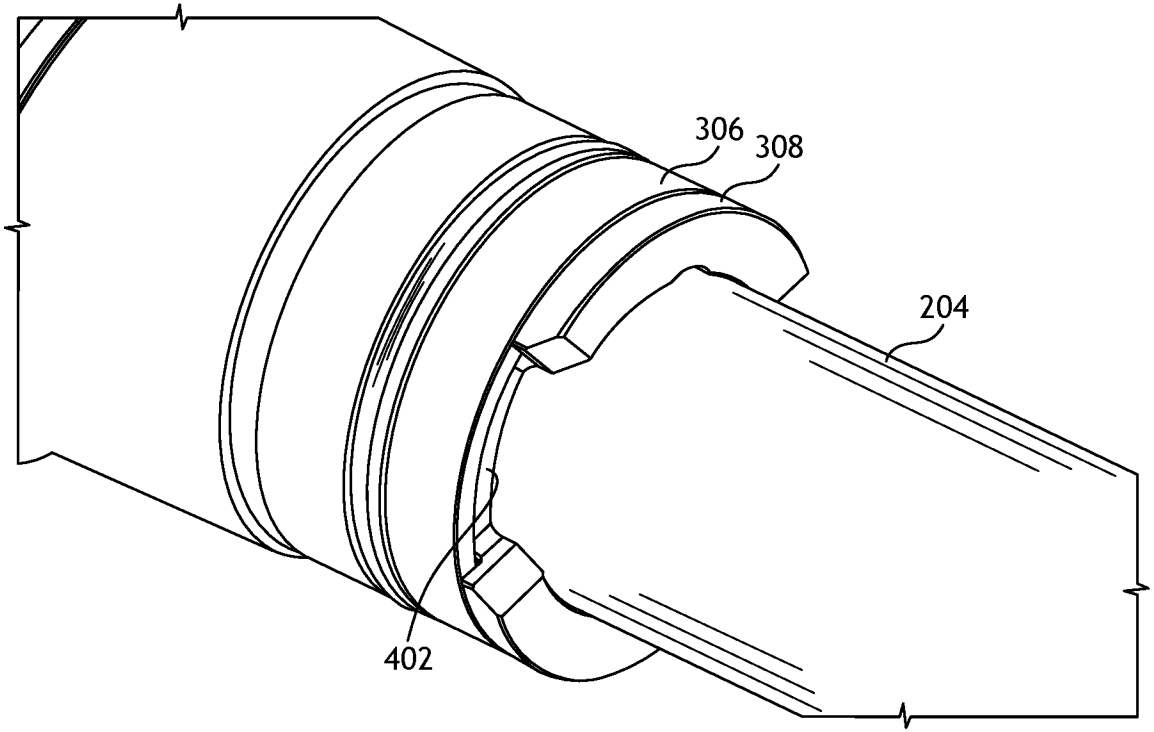
FIG. 4A is an isometric view of the bearing ring and the valve plate of FIG. 3 assembled on the mandrel.

FIG. 4A is an isometric view of the bearing ring 306 and the valve plate 308 assembled on the mandrel 204, and FIG. 4B is an isometric view of the valve plate 308. The bearing ring 306 comprises an annular structure configured to mate with the valve plate 308 when assembled on the mandrel 204. More specifically, the valve plate 308 includes a generally annular body 402 with an outer diameter sized to be received within an inner diameter of the bearing ring 306. Accordingly, as illustrated in FIG. 4A, the valve plate 308 may be partially nested within the bearing ring 306 when assembled on the mandrel 204. During operation of the hydraulic lock piston 300 (FIG. 3), the valve plate 308 may be able to move back and forth between the bearing 306 and the cap 310 (FIG. 3), depending partly on hydraulic fluid flow.

The valve plate 308 also includes at least one valve lobe extending axially and radially from the annular body 402. In the illustrated embodiment, a first valve lobe 404*a* and a second valve lobe 404*b* are provided on the body 402, and the valve lobes 404*a,b* are angularly offset from each other by 180°. In other embodiments, however, the valve lobes 404*a,b* may be angularly offset from each other by other angular magnitudes. Moreover, in some embodiments, more or less than two valve lobes 404*a,b* may be included on the valve plate 308, without departing from the scope of the disclosure.

Figure 5A:
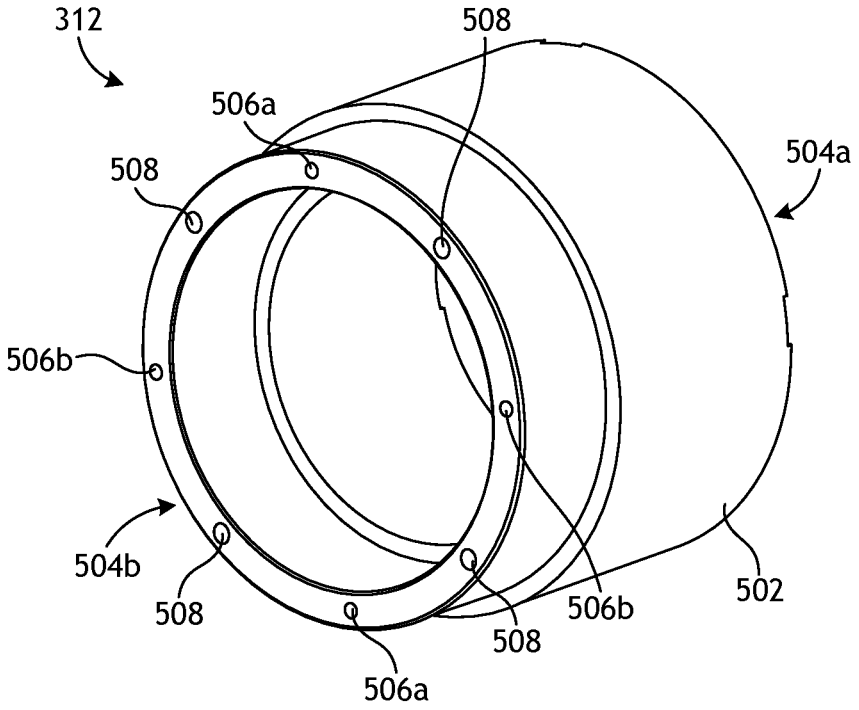
FIGS. 5A-5C are isometric views showing progressive assembly of the piston of FIG. 3.
Figure 5B:
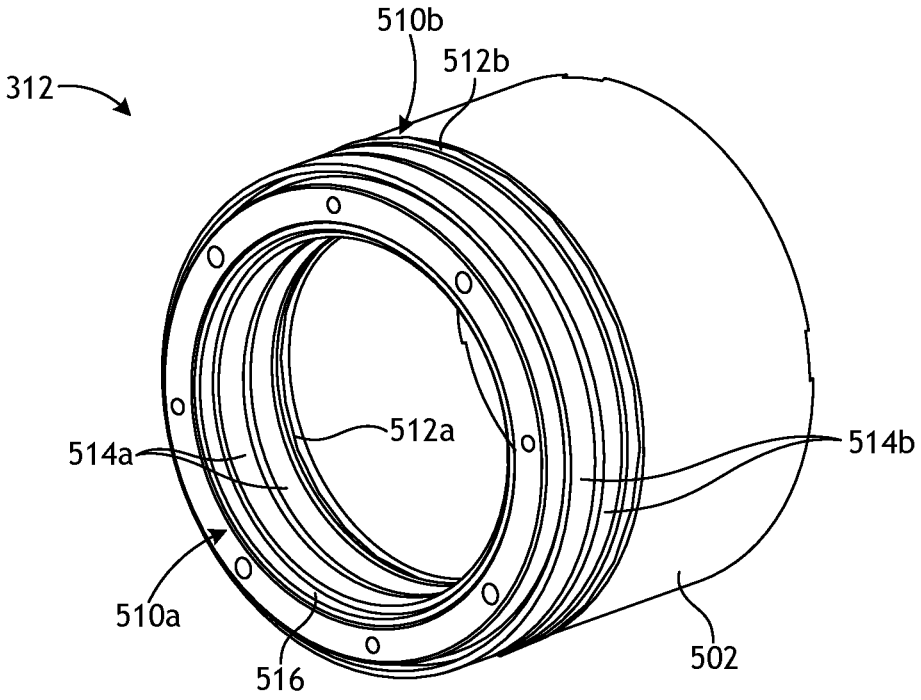
Figure 5C:
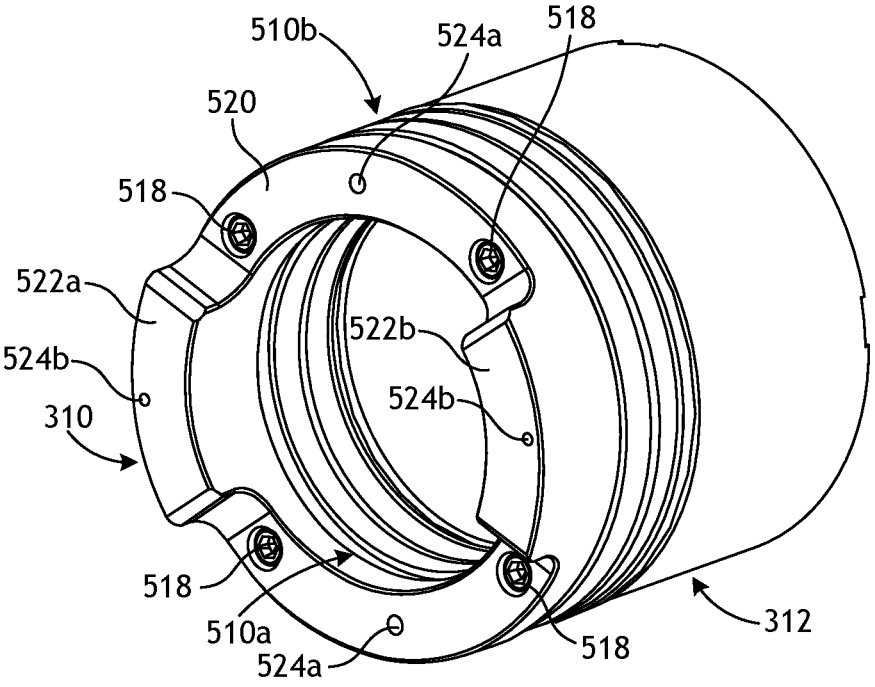

FIGS. 5A-5C are isometric views showing progressive assembly of the pressure piston 312, according to one or more embodiments. Referring first to FIG. 5A, the pressure piston 312 comprises a generally cylindrical body 502 having a first end 504*a* and a second end 504*b* opposite the first end 504*a*. The first end 504*a* may be the same as the downhole end 302*a* of the entire assembly of the hydraulic lock piston 300 of FIG. 3.

One or more first fluid flowpaths 506*a* (two shown) are defined within the wall of the body 502 and extend axially between the first and second ends 504*a,b*. In the illustrated embodiment, the first fluid flowpaths 506*a* are angularly offset from each other by 180°, but could alternatively be angularly offset from each other by other angular magnitudes. Moreover, while two first fluid flowpaths 506*a* are depicted, only one first fluid flowpath 506*a* may be included in the pressure piston 312, without departing from the scope of the disclosure.

One or more second fluid flowpaths 506*b* (two shown) are also defined within the wall of the body 502 and also extend axially between the first and second ends 504*a,b*. Similar to the first fluid flowpaths 506*a*, the second fluid flowpaths 506*b* may be angularly offset from each other by 180°, as illustrated, but could alternatively be angularly offset by other angular magnitudes. Moreover, embodiments are contemplated herein where only one second fluid flowpath 506*b* is employed in the pressure piston 312, without departing from the scope of the disclosure. In the illustrated embodiment, the first and second fluid flowpaths 506*a,b* are angularly offset from each other by 90°, but could alternatively be angularly offset by other angular magnitudes.

The pressure piston 312 may further include one or more apertures 508 (four shown) defined in the second end 504*b* of the body 502. The apertures 508 may comprise threaded apertures configured to receive a corresponding one or more threaded fasteners 518 (FIG. 5C) used to secure the cap 310 (FIG. 5C) to the pressure piston 312, as discussed in more detail below.

In FIG. 5B, an inner seal system 510*a* and an outer seal system 510*b* may be included with the pressure piston 312 and mounted thereto. The inner seal system 510*a* may be configured to provide a sealed interface between the inner radial surface of the pressure piston 312 (i.e., the body 502) and the outer radial surface of the mandrel 204 (FIG. 3) upon which the pressure piston 312 is mounted. As illustrated, the inner seal system 510*a* may include an inner elastomeric seal 512*a*, a set of inner extrusion seal rings 514*a*, and a spacer ring 516. The inner elastomeric seal 512*a* may comprise, for example, an O-ring or the like. The spacer ring 516 may be configured to maintain the inner elastomeric seal 512*a* and the inner extrusion seal rings 514*a* in their axial position relative to the pressure piston 312 during operation.

In contrast, the outer seal system 510*b* may be configured to provide a sealed interface between the outer radial surface of the pressure piston 312 (i.e., the body 502) and an inner radial surface of the housing 202 (FIG. 2) that surrounds the pressure piston 312. As illustrated, the outer seal system 510*b* may include an outer elastomeric seal 512*b* and a set of outer extrusion seal rings 514*b*. Similar to the inner elastomeric seal 512*a*, the outer elastomeric seal 512*b* may comprise, for example, an O-ring or the like. The outer extrusion seal rings 514*b* may be similar to the inner extrusion seal rings 514*a* but configured to provide a sealed interface against the inner radial surface of the housing 202.

In FIG. 5C, the cap 310 is shown coupled to the second end 504*b* of the pressure piston 312. More specifically, one or more threaded fasteners 518 (four shown) may be extended through corresponding holes defined in the cap 310 and threaded into a corresponding one or more of the threaded apertures 508 (FIG. 5A) defined in the second end 504*b* of the body 502. Securing the cap 310 to the pressure piston 312 may also help axially retain the inner and outer seal systems 510*a,b* in place on the pressure piston 312.

As illustrated, the cap 310 may comprise a generally annular body 520 having one or more cap lobes, shown as a first cap lobe 522*a* and a second cap lobe 522*b*. In the illustrated embodiment, the cap lobes 522*a,b* are angularly offset from each other on the body 520 by 180°, but may alternatively be angularly offset from each other by other angular magnitudes. Moreover, while two cap lobes 522*a,b* are depicted in FIG. 5C, more or less than two cap lobes 522*a,b* may be employed, without departing from the scope of the disclosure.

The cap lobes 522*a,b* may be configured to intermesh with the valve lobes 404*a,b* (FIGS. 4A-4B) when the hydraulic lock piston 300 (FIG. 3) is fully assembled. More specifically, the valve lobes 404*a,b* may be sized and otherwise configured to be received within the arcuate portions of the body 520 extending between the cap lobes 522*a,b* such that the valve lobes 404*a,b* and the cap lobes alternate in the angular direction.

The cap 310 may define one or more first exit apertures 524*a* (two shown) that extend axially through the body 520 of the cap 310. When the cap 310 is secured to the pressure piston 312, the first exit apertures 524*a* may axially (and angularly) align with the first fluid flowpaths 506*a* (FIG. 5A) of the pressure piston 312 such that fluids flowing through the first fluid flowpaths 506*a* are conveyed to the first exit apertures 524*a*. Accordingly, the angular orientation of the first exit apertures 524*a* may match the angular orientation of the first fluid flowpaths 506*a*; e.g., 180° offset from each other or offset by another angular magnitude. Moreover, in embodiments where there is only one first fluid flowpath 506*a*, the cap 310 may only provide a corresponding one first exit aperture 524*a* configured to align with the sole first fluid flowpath 506*a*.

The cap 310 may also define one or more second exit apertures 524*b* (two shown) that extend axially through the body 520 of the cap 310. In the illustrated embodiment, the second exit apertures 524*b* also extend through the cap lobes 522*a,b*. When the cap 310 is secured to the pressure piston 312, the second exit apertures 524*b* may axially (and angularly) align with the second fluid flowpaths 506*b* (FIG. 5A) of the pressure piston 312 such that fluids flowing through the second fluid flowpaths 506*b* are conveyed to the second exit apertures 524*b*. Accordingly, the angular orientation of the second exit apertures 524*b* may match the angular orientation of the second fluid flowpaths 506*b*; e.g., 180° offset from each other or offset by another angular magnitude. Moreover, in embodiments where there is only one second fluid flowpath 506*b*, the cap 310 may only provide a corresponding one second exit aperture 524*b* configured to align with the sole second fluid flowpath 506*b*.

In some embodiments, the diameter of the first and second exit apertures 524*a,b* may be the same. In other embodiments, however, the diameter of the first and second exit apertures 524*a,b* may be different. In such embodiments, as illustrated, the diameter of the first exit apertures 524*a* may be greater than the diameter of the second exit apertures 524*b*.

Figure 6A:
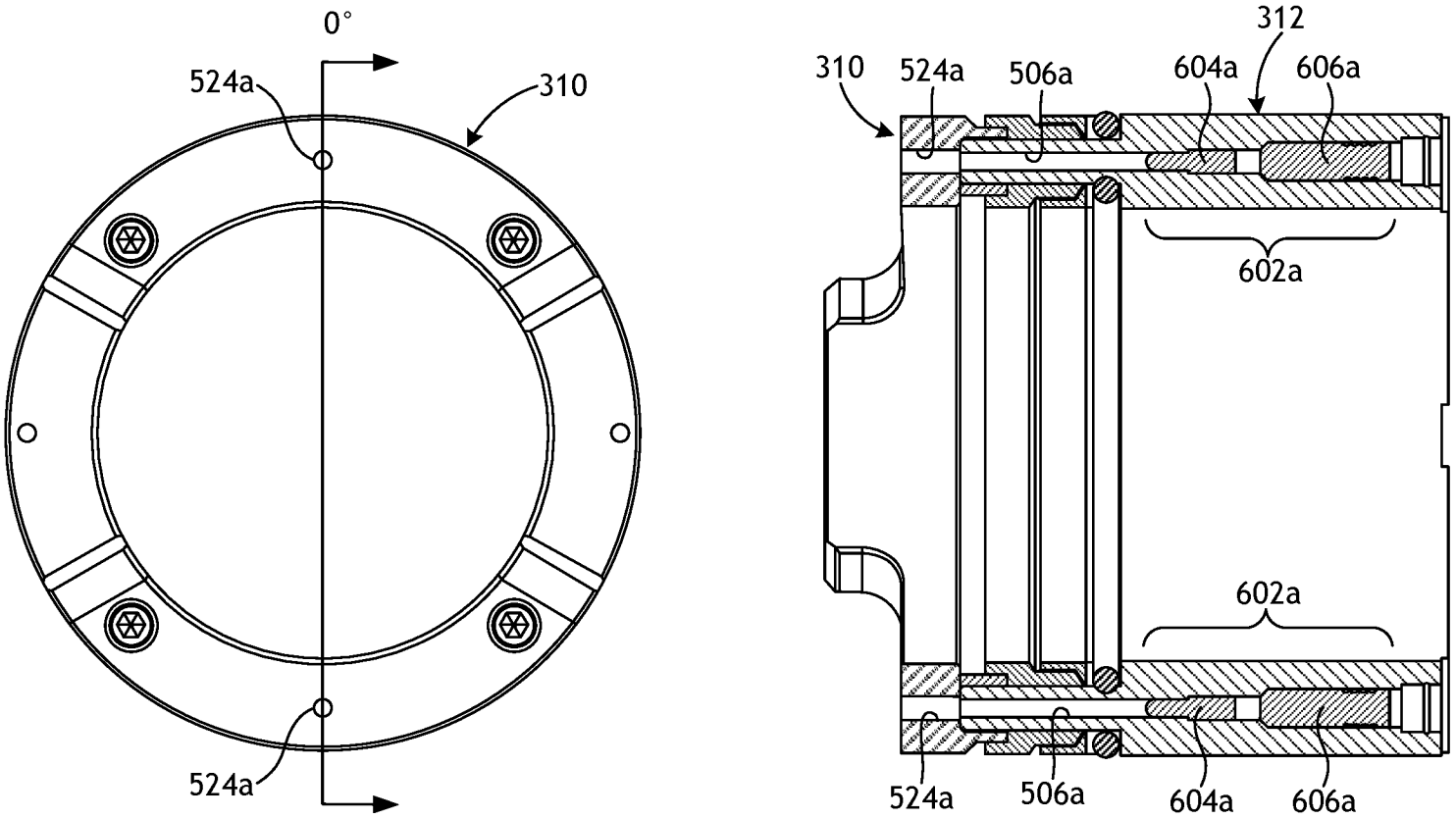
FIGS. 6A and 6B are end and cross-sectional side views of the assembled cap and pressure piston of FIG. 5C.
Figure 6B:
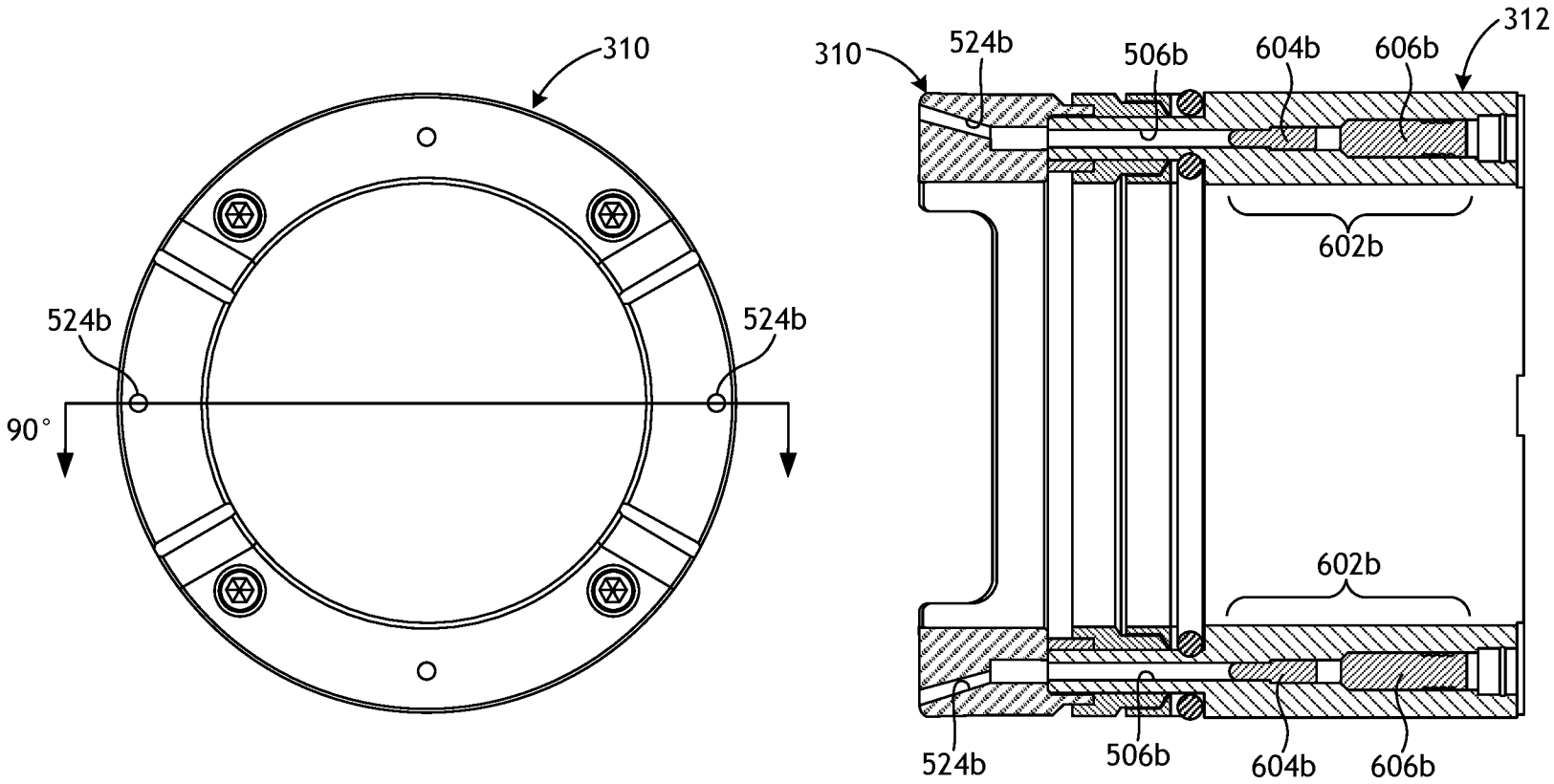

FIGS. 6A and 6B depict end and cross-sectional side views of the assembled cap 310 and pressure piston 312 of FIG. 5C. More specifically FIG. 6A shows a cross-sectional side view of the assembled cap 310 and pressure piston 312 from a first angular perspective (e.g., 0°), and FIG. 6B shows a cross-sectional side view of the assembled cap 310 and pressure piston 312 from a second angular perspective that is 90° offset from the first angular perspective.

In FIG. 6A, the first fluid flowpaths 506*a* of the pressure piston 312 are shown aligned with the first exit apertures 524*a* of the cap 310 such that fluids flowing through the first fluid flowpaths 506*a* can be discharged via the first exit apertures 524*a* when not occluded. Each first fluid flowpath 506*a* may have positioned therein a first flow regulation device 602*a*. The first flow regulation device 602*a* may be configured to regulate the flow of hydraulic fluid from the adjacent pressure chamber 212 (FIG. 2) through the first fluid flowpath 506*a*.

In some embodiments, the first flow regulation device 602*a* may include a first flow restrictor 604*a* configured to meter the hydraulic fluid through the first fluid flowpath 506*a* at a known first flow rate upon actuation of the hydraulic lock piston 300 (FIG. 3) in a first direction. The first flow restrictor 604*a* may comprise, for example, a VISCO JET® brand flow restrictor available from The Lee Company of Westbrook, Conn., USA, but could alternatively comprise other types or brands of flow restrictors, without departing from the scope of the disclosure. In at least one embodiment, for example, the first flow restrictor 604*a* may comprise a flow restricting check valve or another type of flow restricting one-way valve.

In some embodiments, the first flow regulation device 602*a* may further include a first pressure relief valve 606*a*. The first pressure relief valve 606*a* may be designed to open upon achieving a first predetermined pressure threshold (differential) caused by pressurization of the adjacent pressure chamber 212 (FIG. 2). Once the first pressure relief valve 606*a* is opened, hydraulic fluid from the adjacent pressure chamber 212 may be metered through the first flow restrictor 604*a* at the known first flow rate.

While the flow restrictor 604*a* and the pressure relief valve 606*a* are shown as separate component parts of the first flow regulation device 602*a*, it is contemplated herein that the flow restrictor 604*a* and the pressure relief valve 606*a* may comprise a single package device. In other embodiments, however, the pressure relief valve 606*a* may be omitted and the first flow regulation device 602*a* may comprise only the flow restrictor 604*a*, without departing from the scope of the disclosure.

In FIG. 6B, the second fluid flowpaths 506*b* of the pressure piston 312 are shown aligned with the second exit apertures 524*b* of the cap 310 such that fluids flowing through the second fluid flowpaths 506*b* can be discharged via the second exit apertures 524*b* when not occluded. Each second fluid flowpath 506*b* may have positioned therein a second flow regulation device 602*b*. The second flow regulation device 602*b* may be configured to regulate the flow of hydraulic fluid from the adjacent pressure chamber 212 (FIG. 2) through the second fluid flowpath 506*b*.

The second flow regulation device 602*b* may include a second flow restrictor 604*b* configured to meter the hydraulic fluid through the second fluid flowpath 506*b* at a known second flow rate upon actuation of the hydraulic lock piston 300 (FIG. 3) in a second direction. Similar to the first flow restrictor 604*a* of FIG. 6A, the second flow restrictor 604*b* may comprise, for example, a VISCO JET® brand flow restrictor, but could alternatively comprise other types or brands of flow restrictors, without departing from the scope of the disclosure. In at least one embodiment, for example, the second flow restrictor 604*b* may comprise a flow restricting check valve or another type of flow restricting one-way valve.

In some embodiments, the second flow regulation device 602*b* may further include a second pressure relief valve 606*b*. The second pressure relief valve 606*b* may be designed to open upon achieving a second predetermined pressure threshold (differential) caused by pressurization of the adjacent pressure chamber 212 (FIG. 2). Once the second pressure relief valve 606*b* is opened, hydraulic fluid from the adjacent pressure chamber 212 may be metered through the second flow restrictor 604*b* at the known second flow rate.

While the flow restrictor 604*b* and the pressure relief valve 606*b* are shown as separate component parts of the second flow regulation device 602*b*, it is contemplated herein that the flow restrictor 604*b* and the pressure relief valve 606*b* may comprise a single package device. In other embodiments, however, the pressure relief valve 606*b* may be omitted and the second flow regulation device 602*b* may comprise only the flow restrictor 604*b*, without departing from the scope of the disclosure.

FIGS. 7A-7D are cross-sectional side views of the jarring device 130 during example operation. More particularly, FIGS. 7A-7D illustrate progressive example operation of the hydraulic lock piston 300 simultaneously from the first angular perspective (i.e., 0°), as shown in the upper graphic of each of FIGS. 7A-7D, and the second angular perspective (i.e., 90°), as shown in the lower graphic of each of FIGS. 7A-7D.

Figure 7A:
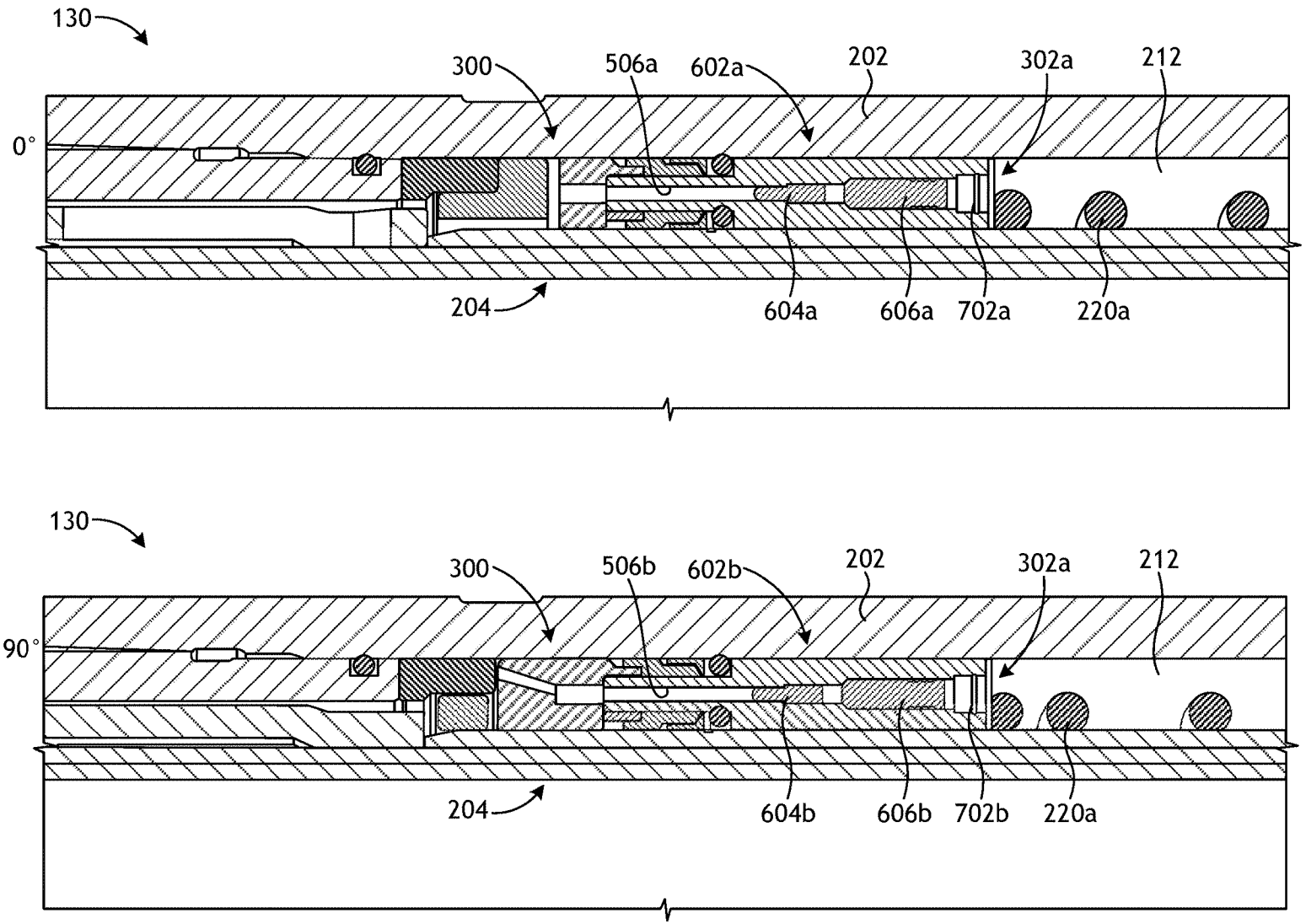
FIGS. 7A-7D are cross-sectional side views of the jarring device of FIG. 3 during example operation.

Referring first to FIG. 7A, as illustrated, the hydraulic lock piston 300 radially interposes the housing 202 and the mandrel 204, and the downhole end 302*a* of the hydraulic lock piston 300 is exposed to the high pressure side of the pressure chamber 212 where the upper coil spring 220*a* resides. As described above, the first and second flow regulation devices 602*a,b* are arranged within the first and second fluid flowpaths 506*a,b*, respectively, and configured to regulate the flow of hydraulic fluid from the adjacent pressure chamber 212 through the first and second fluid flowpaths 506*a,b*. Hydraulic fluid from the pressure chamber 212 can enter the first and second fluid flowpaths 506*a,b* via a first inlet 702*a* and a second inlet 702*b*, respectively.

The hydraulic lock piston 300 may be designed such that the first and second flow regulation devices 602*a,b* are operable to meter hydraulic fluid flow from the pressure chamber 212 during opposite jarring operations in different directions (e.g., upward and downward). More specifically, the first flow regulation device 602*a* may be configured to regulate hydraulic fluid flow from the pressure chamber 212 when jarring in a first or "upward" direction, and the second flow regulation device 602*b* may be configured to regulate hydraulic fluid flow from the pressure chamber 212 when jarring in a second or "downward" direction. As will be appreciated, the first and second flow regulation devices 602*a,b* may alternatively be configured to regulate hydraulic fluid flow in the opposite directions, without departing from the scope of the disclosure. As described below, when one flow regulation device 602*a,b* is metering hydraulic fluid from the pressure chamber 212, the other flow regulation device 602*a,b* may be inoperative or otherwise sealed to hydraulic fluid flow.

Since the first and second flow regulation devices 602*a,b* independently govern hydraulic fluid flow from the pressure chamber 212 during opposite jarring motions, this may allow the hydraulic lock piston 300 to achieve predetermined and distinct threshold push and pull values that must be reached before the jarring device 130 starts to meter fluid for a full jar release. This may also allow the hydraulic lock piston 300 to achieve distinct and predetermined metering and release timings for up and down jarring motions. This may be accomplished by designing the first and second flow regulation devices 602*a,b* with distinct (known) flow and operation characteristics.

More specifically, the first flow restrictor 604*a* of the first flow regulation device 602*a* may be designed to meter the hydraulic fluid through the first fluid flowpath 506*a* at a first flow rate, while the second flow restrictor 604*b* of the second flow regulation device 602*b* may be designed to meter the hydraulic fluid through the second fluid flowpath 506*b* at a second flow rate, where the first and second flow rates are different. Moreover, the first pressure relief valve 606*a* of the first flow regulation device 602*a* may be designed to open upon achieving a first predetermined pressure threshold (differential) caused by pressurization of the adjacent pressure chamber 212, and the second pressure relief valve 606*b* of the second flow regulation device 602*b* may be designed to open upon achieving a second predetermined pressure threshold (differential) caused by pressurization of the pressure chamber 212, where the first and second pressure thresholds are different.

In FIG. 7A, the hydraulic lock piston 300 is depicted in a neutral position, where little or no tensile or compressive load is applied on the mandrel 204. In this position, the jarring device 130 resides at or near the neutral point in the drill string (e.g., the drill string 106 of FIG. 1). To operate the jarring device 130, weight is either removed or applied to the drill string, which correspondingly moves the neutral point either uphole (upward) or downhole (downward) and thereby causes the mandrel 204 to move either uphole or downhole relative to the housing 202.

Figure 7B:
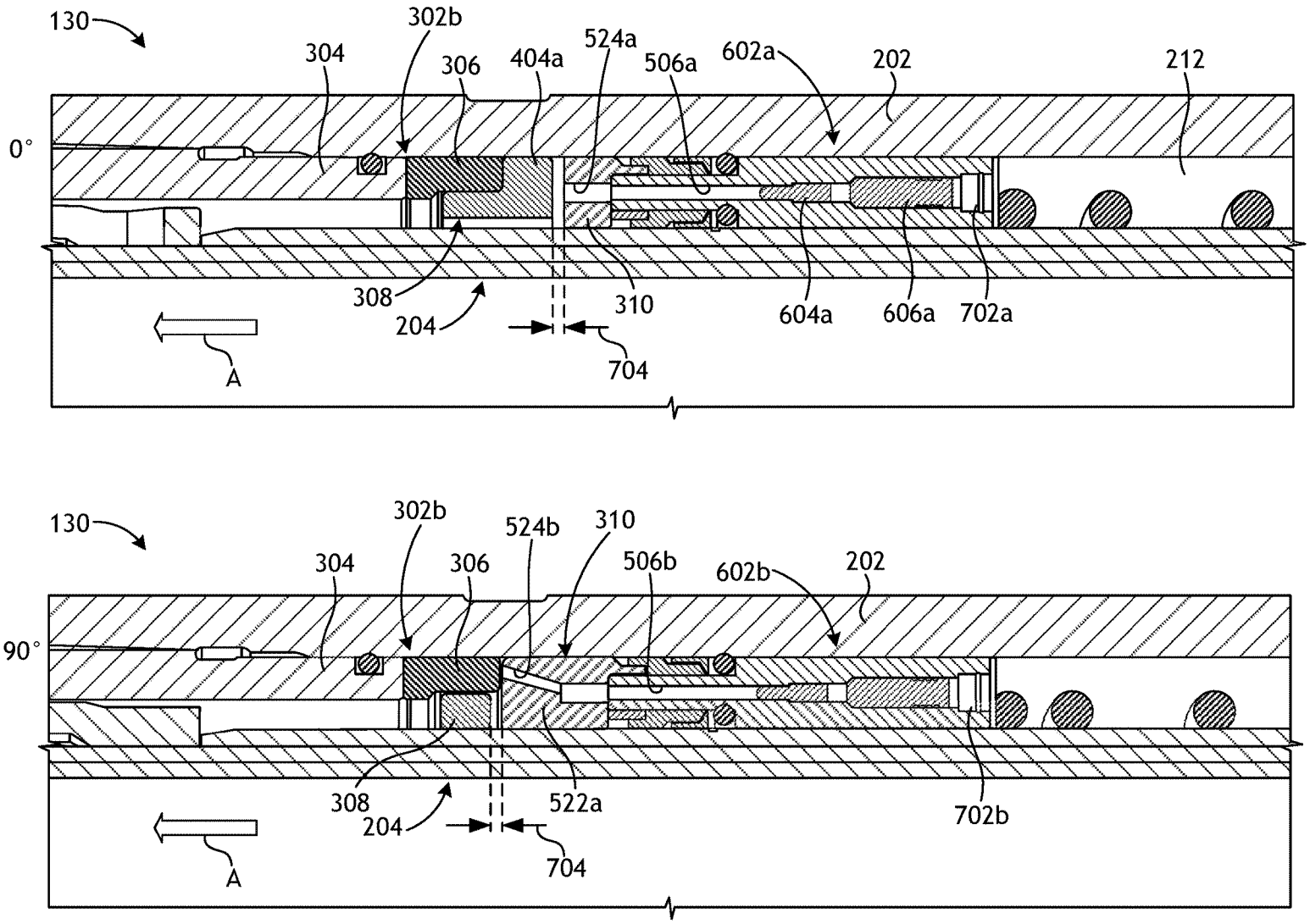

In FIG. 7B, the jarring device 130 has commenced an upward jarring operation by moving the mandrel 204 in a first or "upward" direction relative to the housing 202, as indicated by the arrow A. As the mandrel 204 moves upward relative to the housing 202, the hydraulic lock piston 300 is simultaneously carried in the same direction and the bearing 306 at the first end 302*b* of the hydraulic lock piston 300 is urged against the housing 202 and, more particularly, against the inner collar portion 304 of the housing 202.

Referring to the first angular perspective (i.e., the upper graphic in FIG. 7B), when the mandrel 204 moves in the direction A, the valve plate 308 is able to axially separate from the cap 310 such that a gap 704 is provided therebetween. More specifically, the gap 704 may be defined between the valve lobe 404*a* of the valve plate 308 and the first exit aperture 524*a* defined in the cap 310. The gap 704 at the first exit aperture 524*a* allows hydraulic fluid to exit the first exit aperture 524*a*. In other embodiments, however, the gap 704 may be created when hydraulic fluid is discharged from the first exit aperture 524*a* impinges upon and moves the valve plate 308 away from the cap 310.

In contrast, and referring to the second angular perspective (i.e., the lower graphic in FIG. 7B), when the mandrel 204 moves in the direction A, the cap 310 is urged into axial engagement with the bearing 306. More specifically, the cap lobe 522*a* of the cap 310 is forced against the bearing 306, and the second exit aperture 524*b* is thereby occluded by the bearing 306, which effectively occludes the second fluid flowpath 506*b*. The gap 704 is still provided between the valve plate 308 and the cap 310, but the intermeshed assembly of the lobes 404*a*, 522*a* of the valve plate 308 and the cap 310, respectively, allows the second exit aperture 524*b* to be sealed shut against the bearing 308 during upward jarring motion.

As the mandrel 204 continues upward movement relative to the housing 202, the size of the pressure chamber 212 decreases and the fluid pressure correspondingly increases. The elevated fluid pressure within the pressure chamber 212 acts on the first and second flow regulation devices 602*a,b* via the first and second inlets 702*a,b*, and a pressure differential is created across each flow regulation device 602*a,b*. Since the second exit aperture 524*b* is occluded by the bearing 306, however, the second fluid flowpath 506*b* is correspondingly occluded and hydraulic fluid cannot flow therethrough.

In contrast, since the valve plate 308 does not seal against the cap 310 or is otherwise axially offset from the first exit aperture 524*a* defined in the cap 310, hydraulic fluid can flow through the first fluid flowpath 506*a*. In embodiments where the first pressure relief valve 606*a* is omitted and the first flow regulation device 602*a* only includes the first flow restrictor 604*a*, the pressurized hydraulic fluid within the pressure chamber 212 may start metering through the first flow restrictor 604*a* at the first flow rate and exit the first fluid flowpath 506*a* at the first exit aperture 524*a*. In such embodiments, the mandrel 204 may slowly move in the upward direction A as regulated by the metering rate of the first flow restrictor 604*a*.

In embodiments where the first pressure relief valve 606*a* is included, the pressure within the pressure chamber 212 may increase until reaching the first pressure threshold, at which point the first pressure relief valve 606*a* may open to allow the hydraulic fluid to be metered through the first flow restrictor 604*a* at the first flow rate. Until the first pressure relief valve 606*a* is opened, however, fluid flow through the first fluid flowpath 506*a* is prevented.

The mandrel 204 may continue its upward movement relative to the housing 202 until the tripping valve 216 (FIG. 2) is opened and pressure within the pressure chamber 212 is immediately removed, as generally described above. Once the pressure is removed, the mandrel 204 is then able to accelerate rapidly relative to the housing 202, thereby causing the hammer 232 (FIG. 2) carried by the mandrel 204 to sharply strike the upper anvil 238 (FIG. 2) provided by the housing 202 and thereby generate the desired upward jarring force. Alternatively, as briefly described above, the jarring device 130 (FIG. 2) may be designed such that the anvil 234 alternatively accelerates to sharply strike the hammer 232 and thereby provide the upward jarring force, without departing from the scope of the disclosure.

Following a jarring release, the jarring device 130 can be re-cocked to the neutral position. In some embodiments, this occurs naturally as the system seeks mechanical and hydraulic equilibrium.

Figure 7C:
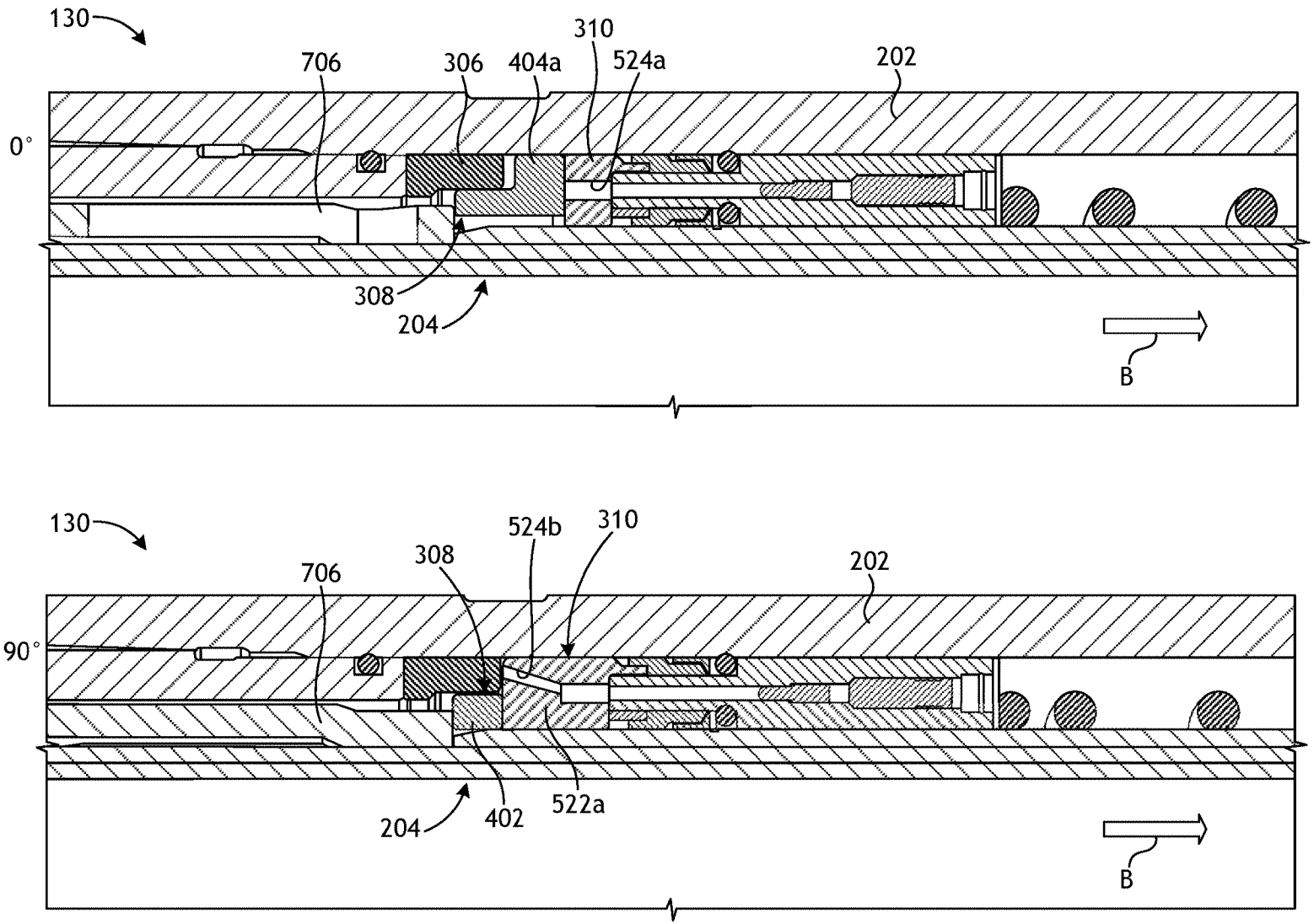

In FIG. 7C, the jarring device 130 has commenced a downward jarring operation by moving the mandrel 204 in a second or "downward" direction relative to the housing 202, as indicated by the arrow B. As the mandrel 204 moves downward relative to the housing 202, a sleeve member 706 of the mandrel 204 extends through the bearing 306 and engages the uphole end of the valve plate 308 and correspondingly pushes the valve plate 308 in the downward direction B.

Referring to the first angular perspective (i.e., the upper graphic in FIG. 7C), movement of the mandrel 204 in the downward direction B closes the gap 704 of FIG. 7B and urges the valve plate 308 into axial engagement with the cap 310. More specifically, the valve lobe 404*a* of the valve plate 308 is forced against the cap 310, and the first exit aperture 524*a* is thereby occluded and sealed by the valve plate 308, which effectively occludes the first fluid flowpath 506*a*. The intermeshed assembly of the lobes 404*a*, 522*a* of the valve plate 308 and the cap 310, respectively, allows the first exit aperture 524*a* to be sealed shut against the valve plate 308 during downward jarring motion.

In contrast, and referring to the second angular perspective (i.e., the lower graphic in FIG. 7C), when the mandrel 204 moves in the direction B, the valve plate 308 correspondingly moves axially adjacent the cap 310. In some embodiments, as illustrated, the second exit aperture 542*b* may be angled to ensure that the annular body 402 does not axially occlude the second exit aperture 524*b*.

Figure 7D:
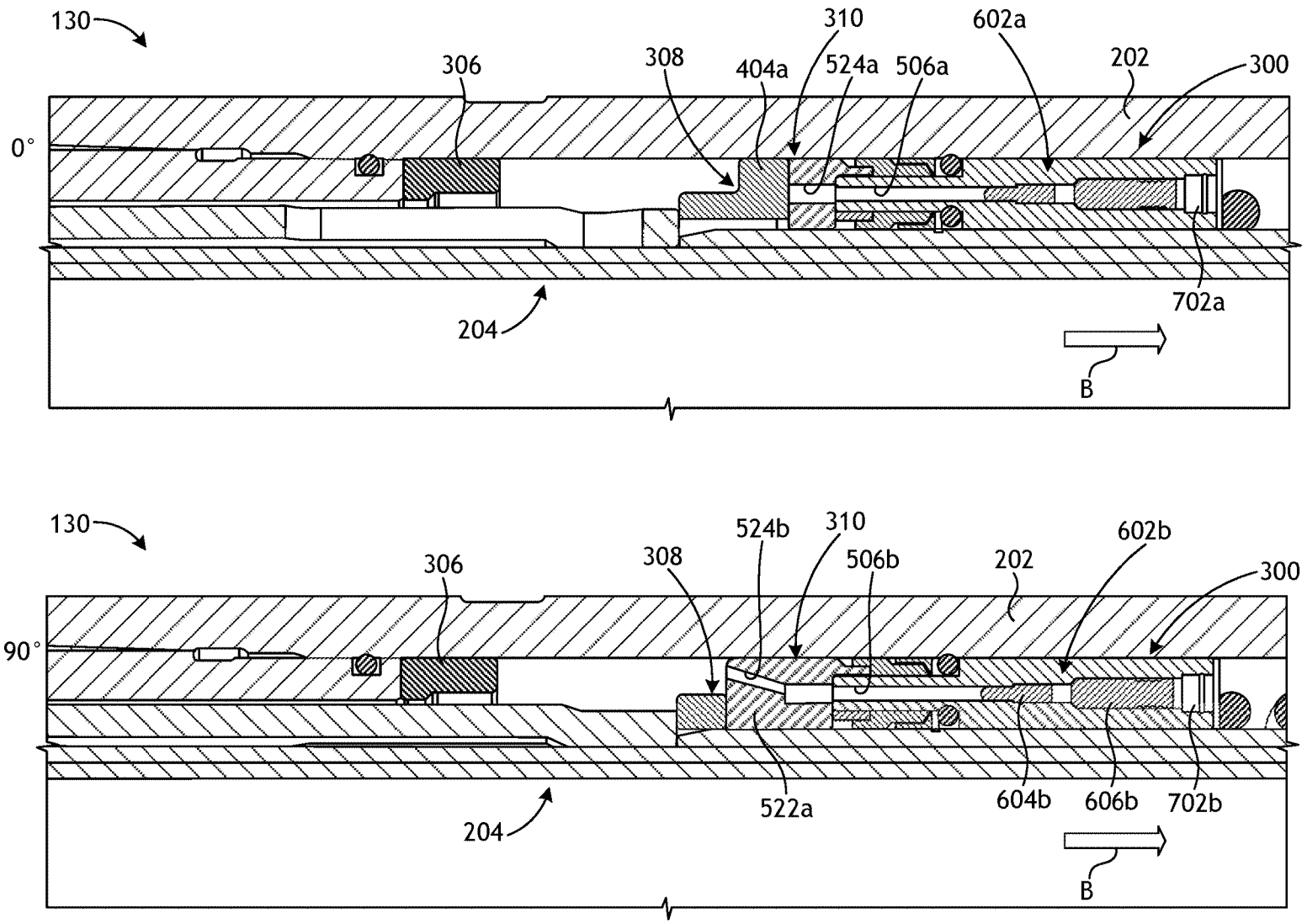

FIG. 7D depicts further downward movement of the mandrel 204 relative to the housing 202 in the downward direction B. As the mandrel 204 continues downward movement relative to the housing 202, the hydraulic lock piston 300 is carried in the same direction as the valve plate 308 is forced against the cap 310. Moreover, the cap lobe 522*a* of the cap 310 separates from the bearing 308 to expose the second exit aperture 524*b* as the mandrel 204 continues downward movement. In contrast, the valve lobe 404*a* of the valve plate 308 remains engaged against the cap 310 and seals the first exit aperture 524*a* and the first fluid flowpath 506*a*.

Continued movement of the mandrel 204 in the downward direction B correspondingly increases fluid pressure by decreasing the size of the pressure chamber 212. The elevated fluid pressure within the pressure chamber 212 acts on the first and second flow regulation devices 602*a,b* via the first and second inlets 702*a,b* and corresponding pressure differentials are generated across each flow regulation device 602*a,b*. Since the first exit aperture 524*a* is occluded by the valve plate 308 and, more specifically, by the valve lobe 404*a*, hydraulic fluid cannot flow through the first fluid flowpath 506*a*. In contrast, since the second exit aperture 524*b* defined in the cap 310 is exposed, hydraulic fluid can flow through the second fluid flowpath 506*b*.

In embodiments where the second pressure relief valve 606*b* is omitted and the second flow regulation device 602*b* only includes the second flow restrictor 604*b*, the pressurized hydraulic fluid within the pressure chamber 212 may start metering through the second flow restrictor 604*b* at the second flow rate and exit the second fluid flowpath 506*b* at the second exit aperture 524*b*. In such embodiments, the mandrel 204 may slowly move in the downward direction B as regulated by the metering rate of the second flow restrictor 604*b*. In embodiments where the second pressure relief valve 606*b* is included, however, the pressure within the pressure chamber 212 may increase until reaching the second pressure threshold, at which point the second pressure relief valve 606*b* may open to allow the hydraulic fluid to be metered through the second flow restrictor 604*b* at the second flow rate. Until the second pressure relief valve 606*b* is opened, however, fluid flow through the second fluid flowpath 506*b* is prevented.

The mandrel 204 may continue its downward movement relative to the housing 202 until the tripping valve 216 (FIG. 2) is opened and pressure within the pressure chamber 212 is immediately removed, as generally described above. Once the pressure is removed, the mandrel 204 is then able to accelerate rapidly relative to the housing 202, thereby causing the hammer 232 (FIG. 2) carried by the mandrel 204 to sharply strike the anvil 234 (FIG. 2) provided by the housing 202 and thereby generate the downward jarring force.

As will be appreciated, the first and second flow rates of the first and second flow restrictors 604*a,b*, respectively, may be optimized to particular applications. In some embodiments, for example, the first flow rate of the first flow restrictor 604*a* may be greater than the second flow rate of the second flow restrictor 604*b*, but the opposite may alternatively be employed. Moreover, the first and second pressure thresholds of the first and second pressure relief valves 606*a,b*, respectively, may be optimized to particular applications. In some embodiments, for example, the pressure threshold of the first pressure relief valve 606*a* may be greater than the second pressure threshold of the second pressure relief valve 606*b*, but the opposite may alternatively be employed.

Embodiments disclosed herein include:

A. A jarring device that includes a housing, a mandrel received within the housing and movable relative thereto, a pressure chamber defined between the housing and the mandrel and filled with a hydraulic fluid, and a hydraulic lock piston arranged about the mandrel and radially interposing the housing and the mandrel, the hydraulic lock piston including a pressure piston having a first end exposed to the pressure chamber, a second end, and first and second fluid flowpaths defined in the pressure piston and extending axially between the first and second ends, wherein, when the mandrel moves in a first direction relative to the housing, the hydraulic fluid is metered through the first fluid flowpath and the second fluid flowpath is occluded, and wherein, when the mandrel moves in a second direction relative to the housing and opposite the first direction, the hydraulic fluid is metered through the second fluid flowpath and the first fluid flowpath is occluded.

B. A method that includes conveying a jarring device into a borehole, the jarring device including a housing, a mandrel received within the housing and movable relative thereto, a pressure chamber defined between the housing and the mandrel and filled with a hydraulic fluid, and a hydraulic lock piston arranged about the mandrel and radially interposing the housing and the mandrel, the hydraulic lock piston including a pressure piston having a first end exposed to the pressure chamber, a second end, and first and second fluid flowpaths defined in the pressure piston and extending axially between the first and second ends. The method further including moving the mandrel in a first direction relative to the housing and thereby increasing a pressure within the pressure chamber, occluding the second fluid flowpath when the mandrel moves in the first direction, metering the hydraulic fluid through the first fluid flowpath and thereby regulating movement of the mandrel in the first direction, actuating a tripping valve arranged within the pressure chamber once the mandrel moves a predetermined distance in the first direction, and accelerating the mandrel relative to the housing and generating a jarring force in the first direction.

C. A method that includes conveying a jarring device into a borehole on a conveyance, the jarring device including a hydraulic lock piston including a pressure piston having a first end exposed to a pressure chamber, a second end, and first and second fluid flowpaths defined in the pressure piston and extending axially between the first and second ends, decreasing a weight on the conveyance at the jarring device and thereby increasing a pressure of hydraulic fluid within the pressure chamber, occluding the second fluid flowpath and metering the hydraulic fluid through the first fluid flowpath, and actuating a tripping valve arranged within the pressure chamber and thereby generating a jarring force in the first direction with the jarring device.

Each of embodiments A, B, and C may have one or more of the following additional elements in any combination: Element 1: wherein the hydraulic lock piston further includes a cap arranged at the second end and defining a first exit aperture aligned with the first fluid flowpath and a second exit aperture aligned with the second fluid flowpath, wherein the cap provides one or more cap lobes and the second exit aperture extends axially through one of the one or more cap lobes, a valve plate arranged adjacent the cap and providing one or more valve lobes that intermesh with the one or more cap lobes, and a bearing ring that mates with the valve plate when assembled on the mandrel. Element 2: wherein the bearing occludes the second exit aperture when the mandrel moves in the first direction and thereby occludes the second fluid flowpath, and wherein one of the one or more valve lobes occludes the first exit aperture when the mandrel moves in the second direction and thereby occludes the first fluid flowpath. Element 3: wherein the valve plate is axially movable between the bearing and the cap. Element 4: wherein the valve plate comprises an annular body and the one or more valve lobes extend axially and radially from the annular body. Element 5: further comprising a first flow regulation device arranged in the first fluid flowpath and including a first flow restrictor that meters the hydraulic fluid through the first fluid flowpath at a first flow rate, and a second flow regulation device arranged in the second fluid flowpath and including a second flow restrictor that meters the hydraulic fluid through the second fluid flowpath at a second flow rate different from the first flow rate. Element 6: wherein the first flow regulation device further includes a first pressure relief valve that opens upon achieving a first pressure threshold, and wherein the second flow regulation device further includes a second pressure relief valve that opens upon achieving a second pressure threshold different from the first pressure threshold. Element 7: wherein the first flow restrictor and the first pressure relief valve comprise a single package device, and wherein the second flow restrictor and the second pressure relief valve comprise a single package device. Element 8: further comprising a tripping valve positioned within the pressure chamber and actuatable to open upon moving the mandrel in the first or second directions. Element 9: wherein the hydraulic lock piston further includes an inner seal system mounted to an inner radial surface of the pressure piston and providing a sealed interface between the pressure piston and an outer radial surface of the mandrel, and an outer seal system mounted to an outer radial surface of the pressure piston and providing a sealed interface between the pressure piston and an inner radial surface of the housing.

Element 10: further comprising resetting the jarring device, moving the mandrel again in the first direction and thereby actuating the tripping valve a second time, and accelerating the mandrel relative to the housing and generating a second jarring force in the first direction. Element 11: further comprising moving the mandrel in a second direction opposite the first direction and relative to the housing and thereby increasing the pressure within the pressure chamber, occluding the first fluid flowpath when the mandrel moves in the second direction, metering the hydraulic fluid through the second fluid flowpath and thereby regulating movement of the mandrel in the second direction, actuating the tripping valve once the mandrel moves a predetermined distance in the second direction, and accelerating the mandrel relative to the housing and generating a jarring force in the second direction. Element 12: wherein the hydraulic lock piston further includes a cap arranged at the second end and defining a first exit aperture aligned with the first fluid flowpath and a second exit aperture aligned with the second fluid flowpath, wherein the cap provides one or more cap lobes and the second exit aperture extends axially through one of the one or more cap lobes, a valve plate arranged adjacent the cap and providing one or more valve lobes that intermesh with the one or more cap lobes, and a bearing ring that mates with the valve plate when assembled on the mandrel, the method further comprising occluding the second exit aperture with the bearing when the mandrel moves in the first direction and thereby occluding the second fluid flowpath, and occluding the first exit aperture with one of the one or more valve lobes when the mandrel moves in the second direction and thereby occluding the first fluid flowpath. Element 13: further comprising metering the hydraulic fluid through the first fluid flowpath at a first flow rate with a first flow restrictor arranged within the first fluid flowpath, and metering the hydraulic fluid through the second fluid flowpath at a second flow rate with a second flow restrictor arranged within the second fluid flowpath, wherein the first and second flow rates are different. Element 14: wherein metering the hydraulic fluid through the first fluid flowpath is preceded by opening a first pressure relief valve arranged within the first fluid flowpath upon achieving a first pressure threshold, and wherein metering the hydraulic fluid through the second fluid flowpath at the second flow rate is preceded by opening a second pressure relief valve arranged within the second fluid flowpath upon achieving a second pressure threshold different from the first pressure threshold. Element 15: further comprising regulating movement of the mandrel in the first direction based on the first flow rate, and regulating movement of the mandrel in the second direction based on the second flow rate.

Element 16: further comprising resetting the jarring device, and altering the weight on the conveyance in the first direction a second time and thereby actuating the tripping valve to generate a second jarring force in the first direction with the jarring device. Element 17: further comprising increasing the weight on the conveyance at the jarring device and thereby increasing the pressure within the pressure chamber, occluding the first fluid flowpath and metering the hydraulic fluid through the second fluid flowpath, and actuating the tripping valve arranged within the pressure chamber and thereby generating a jarring force in the second direction with the jarring device. Element 18: further comprising metering the hydraulic fluid through the first fluid flowpath at a first flow rate with a first flow restrictor arranged within the first fluid flowpath, and metering the hydraulic fluid through the second fluid flowpath at a second flow rate with a second flow restrictor arranged within the second fluid flowpath, wherein the first and second flow rates are different. Element 19: wherein metering the hydraulic fluid through the first fluid flowpath is preceded by opening a first pressure relief valve arranged within the first fluid flowpath upon achieving a first pressure threshold, and wherein metering the hydraulic fluid through the second fluid flowpath at the second flow rate is preceded by opening a second pressure relief valve arranged within the second fluid flowpath upon achieving a second pressure threshold that is different from the first pressure threshold.

By way of non-limiting example, exemplary combinations applicable to A, B, and C include: Element 1 with Element 2; Element 1 with Element 3; Element 1 with Element 4; Element 5 with Element 6; Element 6 with Element 7; Element 11 with Element 12; Element 11 with Element 13; Element 13 with Element 14; Element 13 with Element 15; Element 17 with Element 18; and Element 17 with Element 19.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A jarring device, comprising:

a housing;

a mandrel received within the housing and movable relative thereto;

a pressure chamber defined between the housing and the mandrel and filled with a hydraulic fluid; and a hydraulic lock piston radially interposing the housing and the mandrel and including a pressure piston having first and second ends, first and second fluid flowpaths extending axially between the first and second ends, and a valve plate matable with a bearing ring adjacent the second end, wherein, when the mandrel moves in a first direction relative to the housing, the hydraulic fluid is metered through the first fluid flowpath and the second fluid flowpath is occluded by the bearing ring, and wherein, when the mandrel moves in a second direction relative to the housing and opposite the first direction, the hydraulic fluid is metered through the second fluid flowpath and the first fluid flowpath is occluded by the valve plate.

2. The jarring device of claim 1, wherein the hydraulic lock piston further includes:

a cap arranged at the second end and defining a first exit aperture aligned with the first fluid flowpath and a second exit aperture aligned with the second fluid flowpath, wherein the cap provides one or more cap lobes and the second exit aperture extends axially through one of the one or more cap lobes, wherein the valve plate provides one or more valve lobes that intermesh with the one or more cap lobes.

3. The jarring device of claim 2, wherein the bearing ring occludes the second exit aperture when the mandrel moves in the first direction and thereby occludes the second fluid flowpath, and wherein one of the one or more valve lobes occludes the first exit aperture when the mandrel moves in the second direction and thereby occludes the first fluid flowpath.

4. The jarring device of claim 2, wherein the valve plate comprises an annular body and the one or more valve lobes extend axially and radially from the annular body.

5. The jarring device of claim 1, further comprising:

a first flow regulation device arranged in the first fluid flowpath and including a first flow restrictor that meters the hydraulic fluid through the first fluid flowpath at a first flow rate; and a second flow regulation device arranged in the second fluid flowpath and including a second flow restrictor that meters the hydraulic fluid through the second fluid flowpath at a second flow rate different from the first flow rate.

6. The jarring device of claim 5, wherein the first flow regulation device further includes a first pressure relief valve that opens upon achieving a first pressure threshold, and wherein the second flow regulation device further includes a second pressure relief valve that opens upon achieving a second pressure threshold different from the first pressure threshold.

7. The jarring device of claim 6, wherein the first flow restrictor and the first pressure relief valve comprise a single package device, and wherein the second flow restrictor and the second pressure relief valve comprise a single package device.

8. The jarring device of claim 1, further comprising a tripping valve positioned within the pressure chamber and actuatable to open upon moving the mandrel in the first or second directions.

9. A method, comprising:

conveying a jarring device into a borehole, the jarring device including a housing, a mandrel received within the housing and movable relative thereto, a pressure chamber defined between the housing and the mandrel and filled with a hydraulic fluid, and a hydraulic lock piston radially interposing the housing and the mandrel and including:

a pressure piston having first and second ends, first and second fluid flowpaths extending axially between the first and second ends, and a valve plate matable with a bearing ring adjacent the second end;

moving the mandrel in a first direction relative to the housing and thereby occluding the second fluid flowpath with the bearing ring;

metering the hydraulic fluid through the first fluid flowpath and thereby regulating movement of the mandrel in the first direction;

actuating a tripping valve arranged within the pressure chamber once the mandrel moves a predetermined distance in the first direction; and accelerating the mandrel relative to the housing and generating a jarring force in the first direction.

10. The method of claim 9, further comprising:

resetting the jarring device;

moving the mandrel again in the first direction and thereby actuating the tripping valve a second time; and accelerating the mandrel relative to the housing and generating a second jarring force in the first direction.

11. The method of claim 9, further comprising:

moving the mandrel in a second direction opposite the first direction and relative to the housing and thereby occluding the first fluid flow path with the valve plate;

metering the hydraulic fluid through the second fluid flowpath and thereby regulating movement of the mandrel in the second direction;

actuating the tripping valve once the mandrel moves a predetermined distance in the second direction; and accelerating the mandrel relative to the housing and generating a jarring force in the second direction.

12. The method of claim 11, wherein the hydraulic lock piston further includes a cap arranged at the second end and defining a first exit aperture aligned with the first fluid flowpath and a second exit aperture aligned with the second fluid flowpath, wherein the cap provides one or more cap lobes and the second exit aperture extends axially through one of the one or more cap lobes, the method further comprising:

occluding the second exit aperture with the bearing ring when the mandrel moves in the first direction and thereby occluding the second fluid flowpath; and occluding the first exit aperture with one or more valve lobes of the valve plate when the mandrel moves in the second direction and thereby occluding the first fluid flowpath, wherein the one or more valve lobes intermesh with the one or more cap lobes.

13. The method of claim 11, further comprising:

metering the hydraulic fluid through the first fluid flowpath at a first flow rate with a first flow restrictor arranged within the first fluid flowpath; and metering the hydraulic fluid through the second fluid flowpath at a second flow rate with a second flow restrictor arranged within the second fluid flowpath, wherein the first and second flow rates are different.

14. The method of claim 13, wherein metering the hydraulic fluid through the first fluid flowpath is preceded by opening a first pressure relief valve arranged within the first fluid flowpath upon achieving a first pressure threshold, and wherein metering the hydraulic fluid through the second fluid flowpath at the second flow rate is preceded by opening a second pressure relief valve arranged within the second fluid flowpath upon achieving a second pressure threshold different from the first pressure threshold.

15. The method of claim 13, further comprising:

regulating movement of the mandrel in the first direction based on the first flow rate; and regulating movement of the mandrel in the second direction based on the second flow rate.

16. A method, comprising:

conveying a jarring device into a borehole on a conveyance, the jarring device including a hydraulic lock piston including a pressure piston having a first end exposed to a pressure chamber, a valve plate matable with a bearing ring adjacent a second end of the pressure piston, and first and second fluid flowpaths extending axially between the first and second ends;

altering a weight on the conveyance in a first direction at the jarring device and thereby increasing a pressure of hydraulic fluid within the pressure chamber;

occluding the second fluid flowpath with the bearing ring and metering the hydraulic fluid through the first fluid flowpath; and actuating a tripping valve arranged within the pressure chamber and thereby generating a jarring force in the first direction with the jarring device.

17. The method of claim 16, further comprising:

resetting the jarring device; and altering the weight on the conveyance in the first direction a second time and thereby actuating the tripping valve to generate a second jarring force in the first direction with the jarring device.

18. The method of claim 16, further comprising:

altering the weight on the conveyance in a second direction at the jarring device and thereby increasing the pressure within the pressure chamber;

occluding the first fluid flowpath with the valve plate and metering the hydraulic fluid through the second fluid flowpath; and actuating the tripping valve arranged within the pressure chamber and thereby generating a jarring force in the second direction with the jarring device.

19. The method of claim 18, further comprising:

metering the hydraulic fluid through the first fluid flowpath at a first flow rate with a first flow restrictor arranged within the first fluid flowpath; and metering the hydraulic fluid through the second fluid flowpath at a second flow rate with a second flow restrictor arranged within the second fluid flowpath, wherein the first and second flow rates are different.

20. The method of claim 19, wherein metering the hydraulic fluid through the first fluid flowpath is preceded by opening a first pressure relief valve arranged within the first fluid flowpath upon achieving a first pressure threshold, and wherein metering the hydraulic fluid through the second fluid flowpath at the second flow rate is preceded by opening a second pressure relief valve arranged within the second fluid flowpath upon achieving a second pressure threshold that is different from the first pressure threshold.

* * * * *